US006412560B1

(12) United States Patent
Bernat

(10) Patent No.: US 6,412,560 B1
(45) Date of Patent: Jul. 2, 2002

(54) TUBULAR INJECTOR WITH SNUBBING JACK AND OSCILLATOR

(76) Inventor: Henry A. Bernat, 4426 Tibbs, Shreveport, LA (US) 71106

( * ) Notice: Subject to any disclaimer, the term of this patent is extended or adjusted under 35 U.S.C. 154(b) by 0 days.

(21) Appl. No.: 09/720,526

(22) PCT Filed: Jun. 21, 1999

(86) PCT No.: PCT/US99/13881

§ 371 (c)(1),
(2), (4) Date: Dec. 20, 2000

(87) PCT Pub. No.: WO99/67502

PCT Pub. Date: Dec. 29, 1999

Related U.S. Application Data

(60) Provisional application No. 60/090,138, filed on Jun. 22, 1998.

(51) Int. Cl.[7] ..... E21B 19/22; E21B 19/00; E21B 31/00

(52) U.S. Cl. ..... 166/301; 166/77.3; 166/77.4; 166/104; 166/177.6; 166/379; 166/383; 166/384

(58) Field of Search ..... 166/301, 379, 166/384, 385, 77.2, 77.3, 77.4, 77.6, 177.6, 177.7, 104, 383

(56) References Cited

U.S. PATENT DOCUMENTS

| | | | | |
|---|---|---|---|---|
| 4,119,297 A | * | 10/1978 | Gunther | 166/77.4 |
| 4,366,988 A | * | 1/1983 | Bodine | 166/177.1 |
| 4,585,061 A | * | 4/1986 | Lyons et al. | 166/77.3 |
| 4,621,688 A | * | 11/1986 | Bodine | 166/177.1 |
| 5,180,012 A | * | 1/1993 | Crawford | 166/301 |

* cited by examiner

*Primary Examiner*—Hoang Dang
(74) *Attorney, Agent, or Firm*—John M. Harrison

(57) ABSTRACT

A tubular injector with snubbing jack and oscillator, which eliminates the need for overhead tubular and oscillator support structure and utilizes resonant vibration to remove tubulars (2) and other objects which are stuck in a well. In a first embodiment the apparatus includes a mechanical oscillator (22) mounted on a snubbing jack (30), wherein the tubular load on the snubbing jack (30) can be released and transferred to the oscillator (22) when the tubular (2) is stuck, for vibrating and loosening the tubular (2) in the well. In another embodiment the apparatus is designed to handle coiled tubing (6) and a snubbing-type jack (39) is used in association with a conventional coiled tubing guide (37) and a coiled tubing injector (14), for guiding the coiled tubing (6) from a reel through the guide (37) and through a hollow tubular stem (9) in the oscillating apparatus (22), into the injector (14) and the well.

42 Claims, 5 Drawing Sheets

TUBULAR INJECTOR WITH SNUBBING JACK AND OSCILLATOR

CROSS-REFERENCE TO RELATED APPLICATIONS

This application claims the benefit of U.S. Provisional Application Ser. No. 60/090,138, filed Jun. 22, 1998, now abandoned.

BACKGROUND OF THE INVENTION

Field of the Invention

This invention relates to the running and freeing of stuck or jammed tubulars downhole without the use of overhead tubular and oscillator support structure, using eccentric weight mechanical oscillators. More particularly, the invention includes a snubbing-type jack and an oscillator apparatus having a central tubular stem for accommodating tubulars and designed to utilize resonant frequency vibration in combination with the snubbing-type for freeing tubulars such as drill pipe, casing and other jointed tubulars, as well as continuous or coiled tubing in the well. Freeing of the coiled tubing or other tubulars in the well by typically resonance vibration is effected when the coiled tubing or alternative tubular has been clamped to the oscillator and isolated from the jack. In a first embodiment the oscillator/snubbing jack combination operates to run jointed tubulars in a well and free stuck downhole members by selectively transferring the tubular load from the snubbing jack to the oscillator and operating the oscillator to vibrate and free the tubular load in the well. In a second embodiment the apparatus is modified to run coiled tubing from a reel by adding a "gooseneck" coiled tubing guide and a coiled tubing injector and for guiding the coiled tubing through a central stem of the oscillator and through the injector, into and from the well.

Oil field tubulars such as well liners, casing, tubing and drill pipe which become stuck in a well bore due to various downhole conditions have been one of the principal sources of problems for oil operators and have expanded the business activity of fishing service companies in this century. During this period of time, many new and innovative tools and procedures have been developed to improve the success and efficiency of fishing operations. Apparatus such as electric line free point tools, string shot assisted backoff, downhole jarring tools, hydraulic-actuated tools of various types and various other tools and equipment have been developed for the purpose of freeing stuck or jammed tubulars downhole in a well. Although use of this equipment has become more efficient with time, the escalation in cost of drilling and workover operations has resulted in a proliferation of stuck pipe, liners, casing, and like tubulars downhole, frequently leading to well abandonment as the most expedient resolution of the problem.

The use of vibration, and resonant vibration in particular, as a means of freeing stuck tubulars in a well bore has the potential to be immediately effective and thus greatly and drastically reduce the cost involved in tubular recovery operations. Resonance occurs in vibration when the frequency of the excitation force is equal to the natural frequency of the system. When this happens, the amplitude (or stroke) of vibration will increase without bound and is governed only by the degree of damping present in the system.

A resonant vibrating system will store a significant quantity of energy, much like a flywheel and the ratio of the energy stored to the energy dissipated per cycle is referred to as the systems "Q". A high energy level allows the system to transfer energy to a given load at an increased rate, much like an increase in voltage will allow a flashlight to burn brighter with a given bulb. Only in resonant systems will achieve this energy buildup and exhibit the corresponding efficient energy transmission characteristics which assure large energy delivery and corresponding force application to a stuck region of pipe or tubing.

Under resonant conditions, a string of pipe or tubing will transmit power over its length to a load at the opposite end, with the only loss being that necessary to overcome resistance in the form of damping or friction. In effect, power is transmitted in the same manner as the drilling process transmits rotary power to a bit, the difference being that the motion is axial translation instead of rotation. The load accepts the transmitted power as a large force acting through a small distance. Resonant vibration of pipe or tubing can deliver substantially higher sustained energy levels to a stuck tubular than any conventional method, including jarring. This achievement is due to the elimination of the need to accelerate or physically move the mass of the pipe or tubing string. Under resonant conditions, the power is applied to a vibrating string of pipe or tubing in phase with the natural movement of the pipe or tubing string.

When an elastic body is subjected to axial strain, as in the stretching of a length of pipe, the diameter of the body will contract. Similarly, when the length of pipe or tubing is compressed, its diameter will expand. Since a length of pipe or tubing undergoing vibration experiences alternate tensile and compressive forces as waves along the longitudinal axis (and therefore longitudinal strains), the pipe or tubing diameter will expand and contract in unison with the applied tensile and compressive waves. This means that for alternate moments during a vibration cycle the pipe or tubing may actually be physically free of its bond.

The term "fluidization" is used to describe the action of granular particles when excited by a vibrational source of proper frequency. Under this condition, granular material is transformed into a fluidic state that offers little resistance to movement of body through the media. In effect, it takes some of the characteristics and properties of a liquid. Accordingly, skin friction, the force that confines a stuck tubular, is reduced to a small fraction of its normal value due to any unconsolidated media that may surround the tubular, tending to become fluid at the interface with the vibrating pipe. Accordingly, the vibrational energy received at the stuck area works to effect the release of a stuck tubular member through the application of large percussive forces, fluidization of granular material, dilation and contraction of the pipe or tubing body and a reduction of well bore friction or hole drag.

Snubbing units, coiled tubing units, jacks or casing jacks are typically used in well construction, completion and remedial or workover situations where there is no overhead tubular support structure, and where objects such as various tubulars may be stuck in the well bore and must be removed in order to complete the work. Additionally, the pipe work string or tubing itself may become stuck in the well bore and must be freed and recovered so that the work can continue. In either event, pipe or tubing vibration from the surface may be used as a method of recovering the stuck tubular members or the work string itself and for reducing tubular insertion and removal friction, as well as other useful purposes.

A typically resonant vibration system used in connection with snubbing-type jacks and units in oilfield tubular running and extraction applications according to this invention, consists of a mechanical oscillator mounted by means of vibration insulators, isolators or reflectors on a snubbing-type unit or jack. Under circumstances where the tubular in the well is coiled tubing, a coiled tubing injector and a "gooseneck" coiled tubing guide are added to this combination. The oscillator generates an axial sinusoidal force that can be tuned to a given frequency within a specified operating range when the tubular is clamped or otherwise secured to the oscillator and is thus isolated from the snubbing-type jack when the tubular is released by the jack or tubing injector and suspended by the operator. The axial force generated by the oscillator acts on the tubular extending through the snubbing unit or coiled tubing injector and secured to the oscillator, to create axial vibration of the tubular. When tuned to a resonant frequency of the system, energy developed at the oscillator is efficiently transmitted to the stuck member, with the only losses being those attributed to frictional resistance. The effect of the system reactance is eliminated because mass inductance is equal to spring capacitance at the resonant frequency. The total resonant system is designed such that the components act in concert with one another, thus providing an efficient and effective extraction system.

The principal of resonant axial vibration of pipe and other threaded tubulars can therefore be applied to coiled tubing, as well as threaded tubulars such as casing and drill pipe, using a snubbing-type or load-bearing unit of substantially any design for running the coiled tubing in and out of a well. The combination of a mechanical oscillator and a snubbing-type jack, along with a "gooseneck" tubing guide and a coiled tubing injector is highly effective to "run" the tubing and to remove stuck coiled tubing from a well, as well as maintaining and enabling good well control, along with the facility for circulating fluids through the coiled tubing into and from the well.

Various pipe recovery techniques are well known in the art. An early pipe recovery device is detailed in U.S. Pat. No. 2,340,959, dated Feb. 8, 1944, to P. E. Harth. The Harth device is characterized by a suitable electrical or mechanical vibrator which is inserted into the pipe to be removed, such that the vibrator may be activated to loosen the pipe downhole in the well and enable removal of the pipe. A well pipe vibrating apparatus is detailed in U.S. Pat. No. 2,641,927, dated Jun. 16, 1953, to D. B. Grabel, et al. The device includes a vibrating element and a motor-powered drive which is inserted in a well pipe to be loosened and removed, to effect vibration of the pipe and subsequent extraction of the pipe from the well. U.S. Pat. No. 2,730,176, dated Jan. 10, 1956, to W. K. J. Herbold, details a means for loosening pipes in underground borings. The apparatus includes a device arranged within a paramagnetic cylindrical body; including a drill, a rod rotatably mounted within the body and a disc member secured to one end of the drill rod, the disc member having a mass which is substantially equally distributed around the axis of the drill rod to define a surface of revolution. A motor is provided for rotating the drill rod and a magnetic apparatus for forcing the disc member into physical contact with the inner walls of the body and into rolling contact with the inner surface of the pipe upon rotation of the drill rod, to loosen the pipe downhole. U.S. Pat. No. 2,972,380, dated Feb. 21, 1961, to A. G. Bodine, Jr., details an acoustic method and apparatus for moving objects held tightly within a surrounding medium. The device includes a vibratory output member of an acoustic wave generator attached to an acoustically-free portion of the stuck tubular. The method includes operating the generator at a resonant frequency to establish a velocity node adjacent to the stuck point and a velocity antinode at the coupling point adjacent to the generator, to loosen the stuck member from the well. U.S. Pat. No. 3,189,106, dated Jun. 15, 1965, to A. G. Bodine, Jr., details a sonic pile driver which utilizes a mechanical oscillator and a pile coupling device for coupling the oscillator body to a pile and applying vibrations of the pile to drive the pile into the ground. U.S. Pat. No. 3,500,908, dated Mar. 17, 1970, to D. S. Barler, details apparatus and method for freeing well pipe. The device includes a number of rotatable, power-driven eccentrics which are connected to an elongated member such as a drill pipe that is stuck in an oil well bore hole and to a resiliently-movable support suspended from the traveling block of an oil derrick. When the power-driven eccentrics are operated, the elongated member is subjected to vertically-directed forces that free it from the stuck position. U.S. Pat. No. 4,429,743, dated Feb. 7, 1984, to Albert G. Bodine, details a well servicing system employing sonic energy transmitted down the pipe string. The sonic energy is generated by an orbiting mass oscillator coupled to a central stem, to which the piston of a cylinder-piston assembly is connected. The cylinder is suspended from a suitable overhead suspension device such as a derrick, with the pipe string being suspended from the piston in an in-line relationship. The fluid in the cylinder affords compliant loading for the piston, while the fluid provides sufficiently high pressure to handle the load of the pipe string and any pulling force thereon. The sonic energy is coupled to the pipe string in the longitudinal vibration mode, which tends to maintain this energy along the string. U.S. Pat. No. 4,574,888 dated Mar. 11, 1986, to Wayne E. Vogen, details a "Method and Apparatus For Removing Stuck Portions of A Drill String". The lower end of an elastic steel column is attached to the upper end of the stuck element and the upper end of the column extends above the top of the well and is attached to a reaction mass lying vertically above, through an accelerometer and vertically-mounted compression springs positioned in parallel with a vertically-mounted, servo-controlled, hydraulic cylinder-piston assembly. Vertical vibration is applied to the upper end of the column to remove the stuck element from the well. A "Device For Facilitating the Release of Stuck Drill Collars" is detailed in U.S. Pat. No. 4,576,229, dated Mar. 18, 1986, to Robert L. Brown. The device includes a first member mounted with the drill pipe disposed in a first position and a second member concentrically mounted with a drill collar or drill pipes in a second position below the first position. Rotation of the drill string from the surface causes a camming action and vibration in a specified operative position of the device, which helps to free stuck portions of the drill pipe. U.S. Pat. No. 4,788,467, dated Nov. 29, 1988, to E. D. Plambeck details a downhole oil well vibrating apparatus that uses a transducer assembly spring chamber piston and spring to effect vibration of downhole tubulars. U.S. Pat. No. 5,234,056, dated Aug. 10, 1993, to Albert G. Bodine, details a "Sonic Method and Apparatus For Freeing A Stuck Drill String". The device includes a mechanical oscillator employing unbalanced rotors coupled to the top end of a drill string stuck in a bore hole. Operation of the unbalanced rotors at a selected frequency provides resonant vibration of the drill string to effect a reflected wave at the stuck point, resulting in an increased cyclic force at this point. Patents detailing jacking devices and coiled tubing and other tubular insertion and removal devices, include U.S. Pat. No. 4,465,131, dated Aug. 14, 1984, to Boyadjieff, et al; U.S. Pat. No. 4,585,061, dated Apr. 29, 1986, to Lyons, et al; U.S. Pat. No. 4,655,291, dated Apr. 7, 1987, to Cox; and U.S. Pat. No. 5,566,764, dated Oct. 22, 1996, to Elliston.

The prior art is well established regarding the application of vibration to stuck downhole tubulars of the conventional type (threaded pipe). However, there is no known technique or suggestion of any means or method for handling continuous pipe or tubing such as coiled tubing, in addition to threaded tubulars, using a mechanical oscillator mounted on a snubbing-type jack or lifting mechanism, in a vibrational application. It is therefore an object of this invention to provide an apparatus for working and freeing coiled tubing or other stuck pipe or equipment in a well without using overhead support structure, wherein the tubing or pipe may be vibrated in the well bore by an oscillator mounted on a support structure in vibration-insulated relationship, which support structure includes a tubing or pipe-lifting and lowering apparatus.

Another object of this invention is to provide a new and improved coiled tubing and threaded tubular running and recovery apparatus, including an oscillator having a hollow central stem for receiving the tubular and a snubbing jack in the case of the threaded tubulars, and including a snubbing-type jack or lifting mechanism, a coiled tubing guide and a coiled tubing injector where coiled tubing is used, which apparatus facilitates running, releasing and recovering by vibration, the tubulars and other objects stuck or jammed downhole in a well.

Yet another object of this invention is to provide a new and improved tubing injector with snubbing-type jack or lifting mechanism and oscillator apparatus, which combines a mechanical oscillator having a hollow central stem or tube and clamps for receiving coiled tubing, a coiled tubing guide for guiding the coiled tubing from a reel to the oscillator, a coiled tubing injector for receiving the tubing from the oscillator and running the tubing in a well and a snubbing-type jack for raising and lowering the oscillator, which oscillator is selectively clamped to the coiled tubing and generates a resonant vibration to facilitate the release of stuck or jammed coiled tubing in the well.

Another object of the invention is, to provide a new and improved coiled tubing oscillating/snubbing-type jack or lifting apparatus, including a coiled tubing guide and injector, that may be applied to a continuous length of coiled tubing without cutting the tubing and operated to run, isolate and vibrate the coiled tubing and remove the coiled tubing from a stuck or jammed position in a well.

A still further object of this invention is to provide a new and improved coiled tubing oscillating/snubbing-type jack apparatus for running and freeing tubulars in a well, which apparatus is characterized by a mechanical oscillator, a snubbing-type jack or lifting device located above an injector head seated on the wellhead or other well structure and a coiled tubing guide or "gooseneck" positioned above the oscillator and adapted to receive a length of coiled tubing from a reel and direct the coiled tubing through a hollow central stem and a pair of clamps in the oscillator and through the coiled tubing injector head, into and from the well, wherein the oscillator is typically mounted on the snubbing-type jack in vibration-insulated and isolated relationship to facilitate selectively clamping the coiled tubing to the oscillator and thus isolating and vibrating the coiled tubing and removing the coiled tubing from a stuck or jammed condition in the well.

Still another object of this invention is to provide a tubing injector with snubbing-type jack and oscillator apparatus which utilizes a mechanical oscillator mounted on a snubbing-type jack by means of vibration-isolating members and receiving a length of coiled tubing from a reel through a tubing guide for feeding to the coiled tubing injector and isolating the coiled tubing using clamps, applying a resonant vibration directly to the coiled tubing and raising and/or lowering the oscillator by operation of its jack, thus removing the coiled tubing from a stuck or jammed condition in a well.

Another object of this invention is to provide an oscillator/snubbing-type jack apparatus and method of operation, which oscillator is mounted on the snubbing-type jack by means of typically rubber or spring vibration insulators, isolators or reflectors and operates to run threaded tubulars in a well and to release stuck tubulars by vibration. In the case of coiled tubing, the oscillator/snubbing jack combination includes a coiled tubing guide, or "gooseneck" and a coiled tubing injector for receiving a length of coiled tubing extending from a coiled tubing reel and directing the coiled tubing through a hollow bore or channel and a pair of clamps in the oscillator and the coiled tubing injector head, into the well, such that the apparatus cap be operated to clamp the coiled tubing, vibrationally isolate and insulate the coiled tubing from the snubbing-type jack and vibrate the coiled tubing, typically at a resonant frequency, and operate the jack apparatus to remove the coiled tubing from a stuck or jammed condition in the well.

Yet another object of the invention is to provide a method of freeing stuck tubulars, including threaded tubulars such as drill pipe and the like, as well as coiled tubing, in a well using an oscillator and snubbing-type jack running and recovery apparatus, which method includes extending the threaded tubular through a pair of clamps and a tubular stem in the oscillator and through the snubbing jack, clamping the tubular in the oscillator, releasing the tubular from the snubbing jack and vibrating the tubular. When coiled tubing is run, the method includes installing a coiled tubing guide above the oscillator for guiding the coiled tubing from a reel through the oscillator, placing a coiled tubing injector beneath the oscillator over the wellhead or structure for receiving and conventionally running the coiled tubing, clamping the coiled tubing in the oscillator and vibrating the coiled tubing to reduce the friction of tubing insertion and extraction in a well while operating the jack.

SUMMARY OF THE INVENTION

These and other objects of the invention are provided in a new and improved oscillator and snubbing-type jack tubular recovery apparatus and method of operation, which apparatus is characterized in a first preferred embodiment by a snubbing jack fitted with a mechanical oscillator in vibration-insulating and isolating configuration with respect to the snubbing jack. In another embodiment a coiled tubing guide is added for running coil tubing from a reel to the oscillator, along with a coiled tubing injector for running coiled tubing from the oscillator in the well. The coiled tubing is isolated from the snubbing-type jack by clamping the oscillator to the coiled tubing and releasing the coiled tubing from the snubbing-type jack. The method of this invention includes directing a tubular through a tubular stem in an oscillator mounted on a snubbing jack and, in the case of coiled tubing, from a reel through a coiled tubing guide into the oscillator and then to a coiled tubing injector and into the well bore. In the event of a stuck or jammed condition of the tubular in the well bore, the oscillator is clamped on the tubular and operated to isolate the tubular from the snubbing or snubbing-type jack and apply resonant vibration to the tubular to loosen the tubular in the well bore as the jack apparatus is raised and/or lowered to move the tubular up and/or down in the well.

BRIEF DESCRIPTION OF THE DRAWINGS

The invention will be better understood by reference to the accompanying drawings, wherein.

DESCRIPTION OF THE PREFERRED EMBODIMENTS

Figure 1:
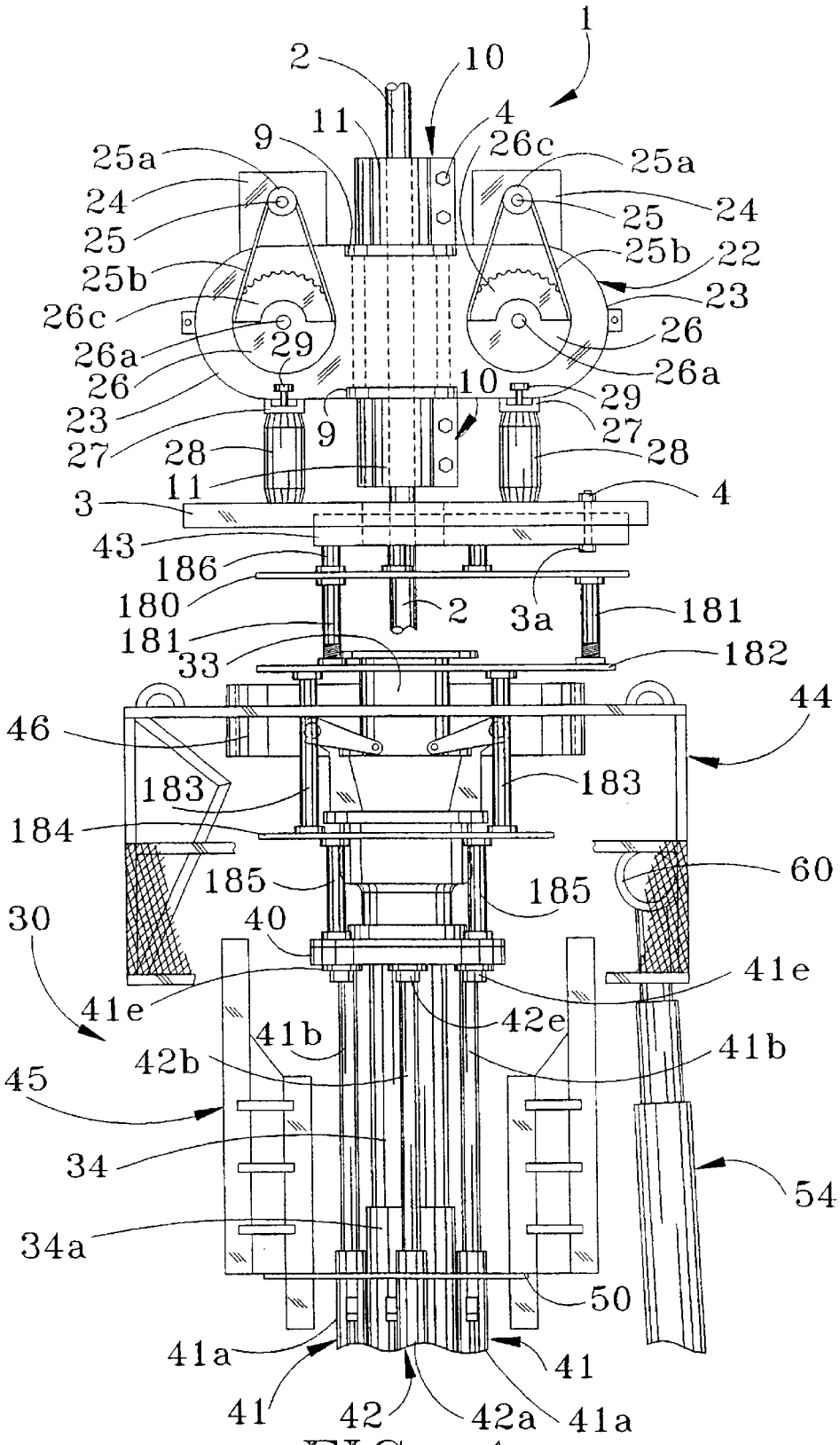
FIG. 1 is a front view of a typical mechanical oscillator and snubbing jack element of a first preferred embodiment of the tubular injector apparatus of this invention, with a length of typically threaded tubular extending through the oscillator and the snubbing jack, into the well.
Figure 1A:
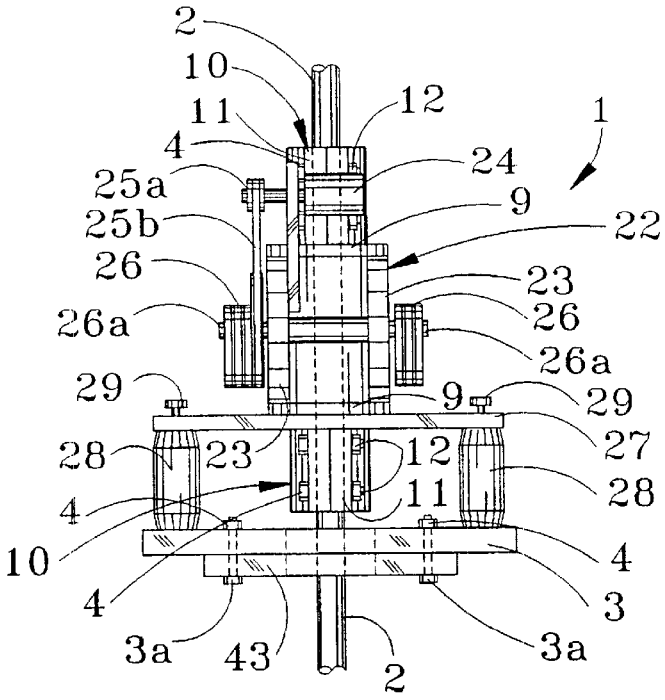
FIG. 1A is a side view of the coiled tubing oscillator illustrated in FIG. 1.
Figure 1B:
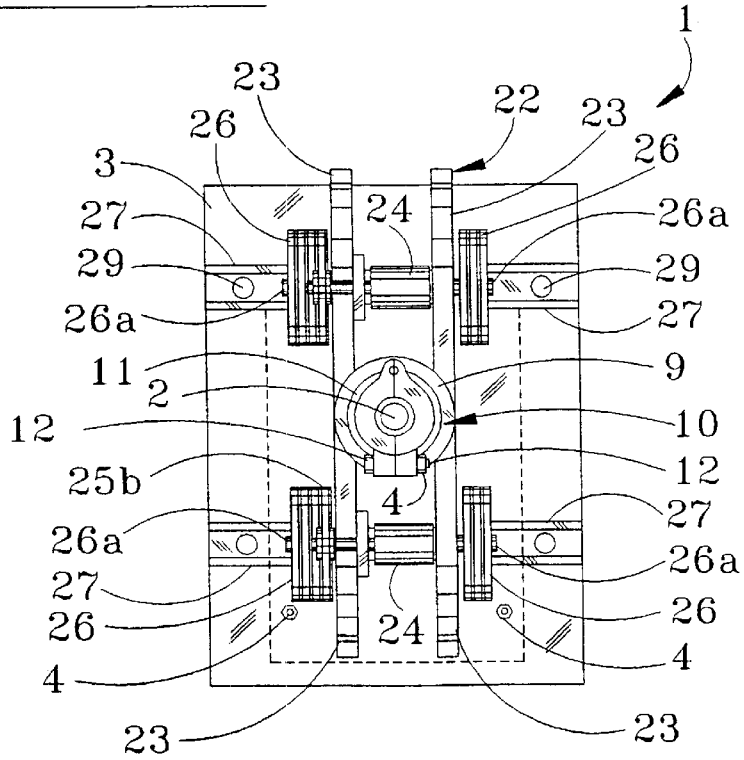
FIG. 1B is a top view of the oscillator illustrated in FIGS. 1 and 1A.

Referring initially to FIGS. 1, 1A, 1B and 2 of the drawings, in a first preferred embodiment, the tubular injector with snubbing jack and oscillator (tubular injector apparatus) of this invention is generally illustrated by reference numeral 1. The tubular injector apparatus 1 is designed to run a typically threaded tubular 2 in and out of a well (not illustrated) and to vibrate the tubular 2 under circumstances where the tubular 2 becomes stuck downhole. Vibration of the tubular 2 is further implemented under circumstances where it is desired to reduce the friction involved in insertion of the tubular 2 into the well and removing the tubular 2 from the well, as hereinafter further described. The tubular injector apparatus 1 is characterized in a first embodiment by an oscillator 22, mounted on a snubbing jack 30, to facilitate vibrating the tubular 2 with respect to the snubbing jack 30, as further hereinafter described. The oscillator 22 is further characterized by an eccentric housing 23, upon which is mounted a pair of eccentric drive motors 24, typically hydraulic in operation, each of the eccentric drive motors 25 having a motor shaft 25, fitted with a shaft pulley 25*a* which receives a shaft pulley belt 25*b*. Each shaft pulley belt 25*b* in turn engages an eccentric shaft pulley 26*c* mounted on an eccentric shaft 26*a*, such that operation of each of the eccentric drive motors 24 facilitates rotation of a corresponding pair of eccentrics 26 and effects vibration of the oscillator 22 and the tubular 2, which is secured to the oscillator 22 and isolated against vibration from the snubbing jack 30, as hereinafter further described. A pair of oscillator mounts 27 is disposed beneath the eccentric housing 23 of the oscillator 22 and a tubular stem 9 extends vertically through the eccentric housing 23 of the oscillator 22 to accommodate the tubular 2, as illustrated in FIGS. 1 and 1A. The bottom of the eccentric housing 23 is attached by welding or otherwise to the oscillator mounts 27 and at least one, but typically four, typically rubber, coil spring, fluid spring or the like, vibration isolators or reflectors 28 is secured to the oscillator mounts 27 in spaced-apart relationship with respect to each other, by means of corresponding reflector mount pins 29, further illustrated in FIGS. 1 and 1A. The bottom ends of the vibration isolators or reflectors 28 engage a base plate 3, extending parallel to and spaced-apart from the oscillator mounts 27, by means of the reflector mount pins 29, which are threaded into or otherwise attached to the base plate 3, as desired. A rotary table 43 is secured to the bottom of the base plate 3 by means of base plate mount bolts 3*a* and corresponding nuts 4, as further illustrated in FIGS. 1 and 1A. A pair of rod clamps 10 are provided on the tubular 2 above and below the tubular stem 9, to facilitate selectively mounting the oscillator 22 on that segment of the tubular 2 which extends through the tubular stem 9 and the clamp jaws 11 of the rod clamps 10. This securing of the oscillator 22 on the tubular 2 is effected by tightening the nuts 4 provided on the jaw bolts 12, the latter of which extend through the clamp jaws 11 to facilitate operating of the oscillator 22 and vibrating the tubular 2 in isolation with respect to the snubbing jack 30, due to the vibration insulating and reflecting effect of the vibration isolators or reflectors 28, as further hereinafter described.

Figure 2:
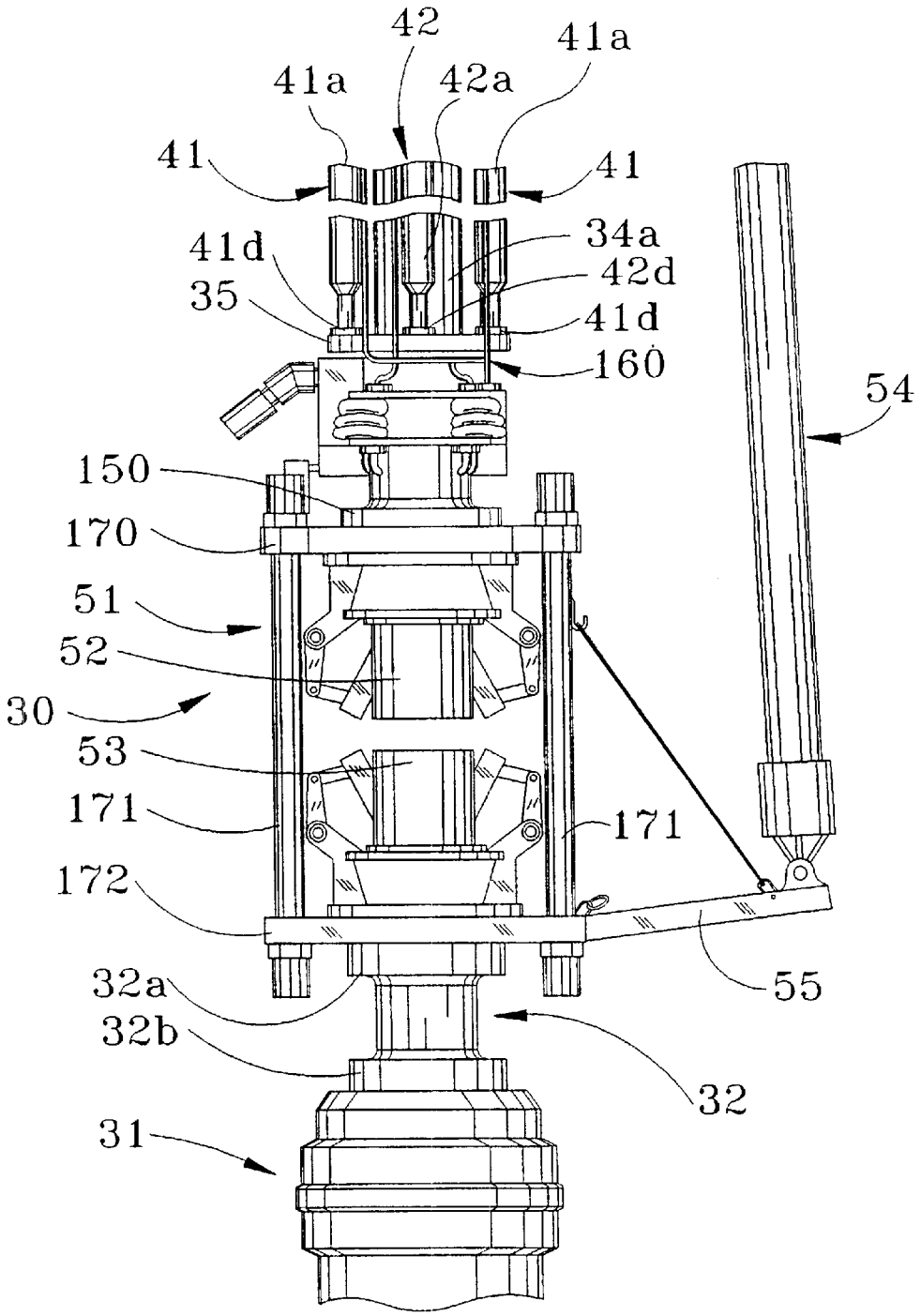
FIG. 2 is a front view of the lower segment of the snubbing jack element of the apparatus illustrated in FIG. 1.
Figure 3:
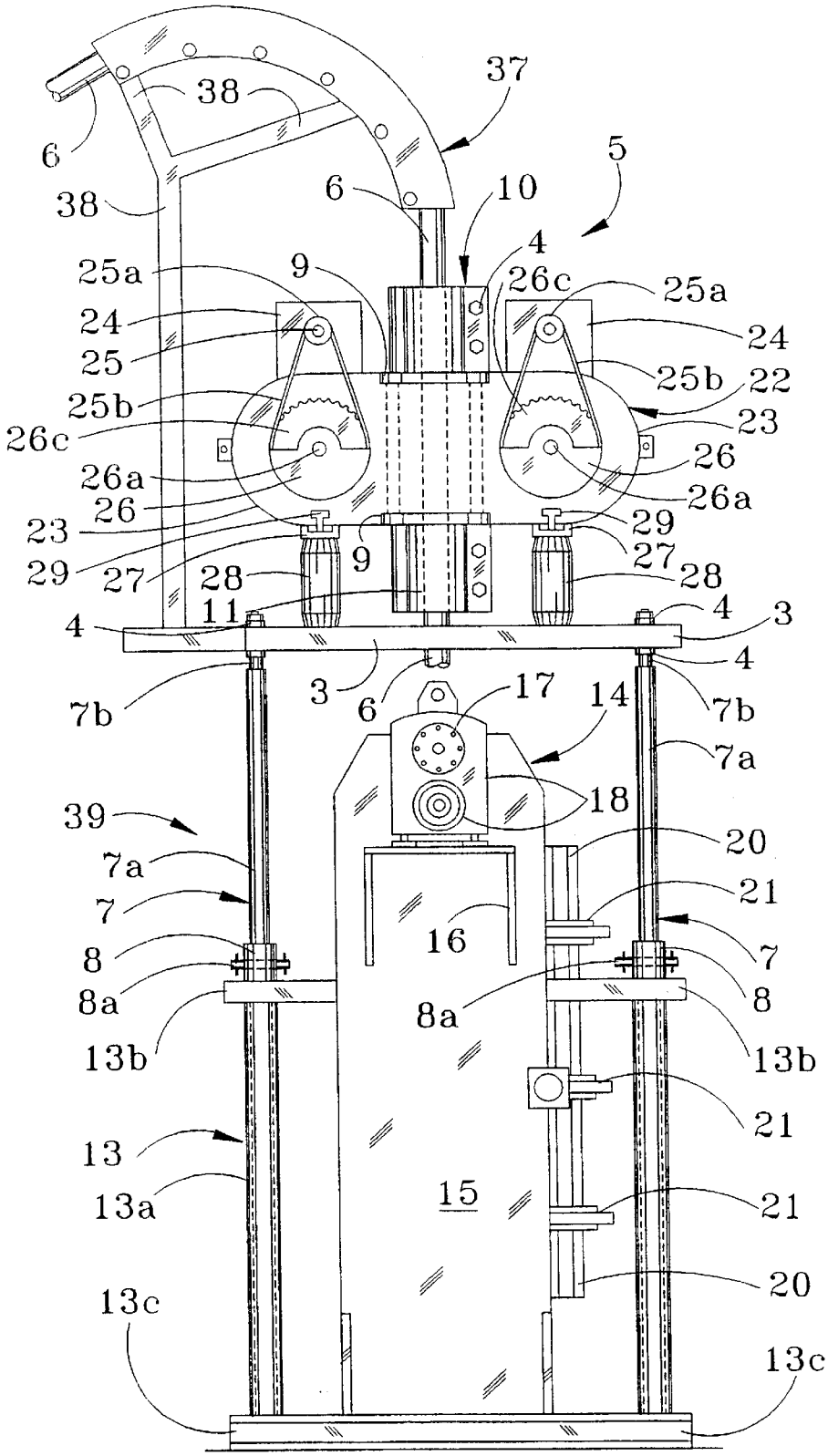
FIG. 3 is a front view of a second preferred embodiment of the tubular injector apparatus, wherein coiled tubing is run in a well by operation of a mechanical oscillator and a snubbing-type jack or lifting mechanism, along with a coiled tubing guide and a coiled tubing injector.
Figure 4:
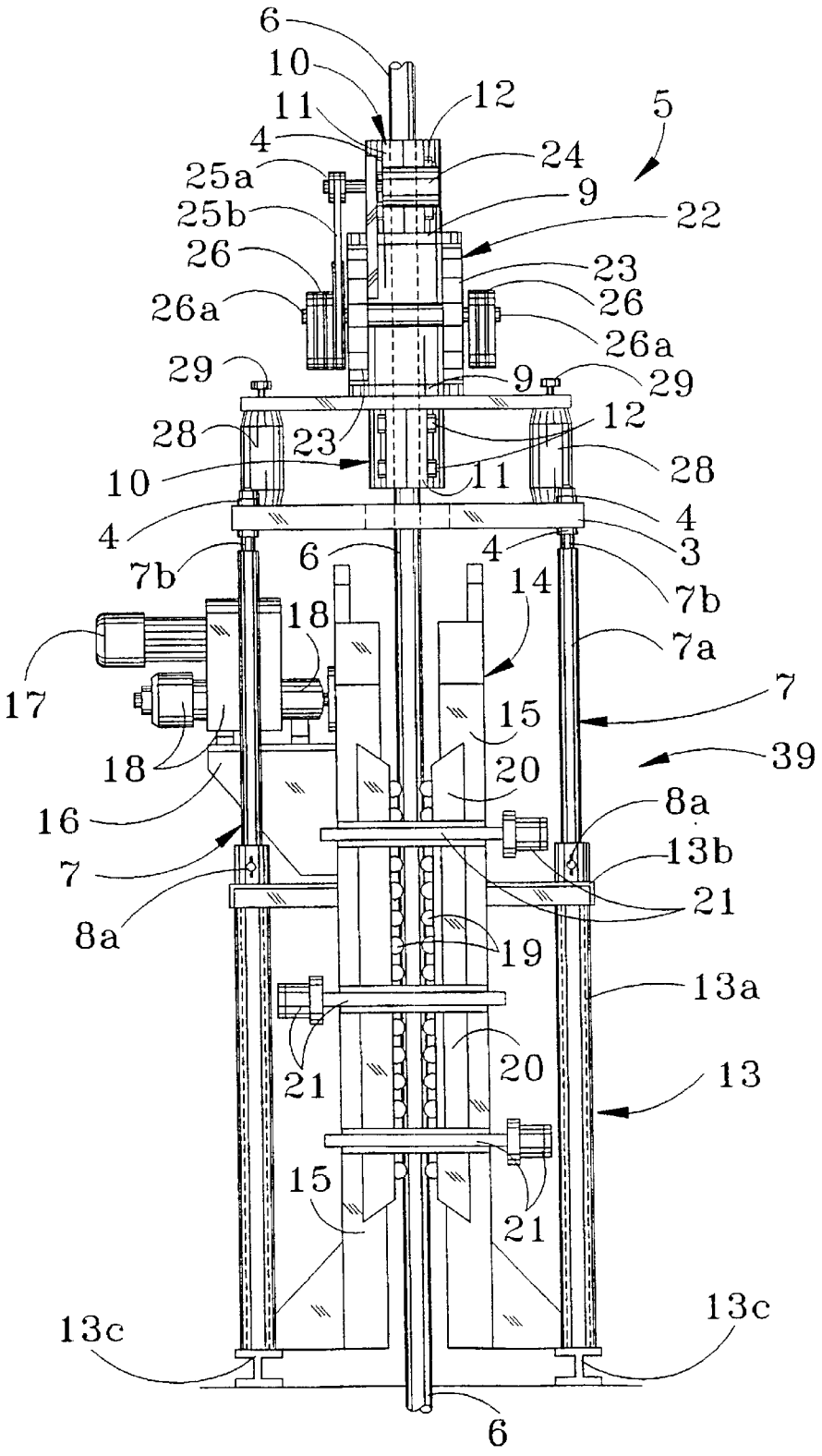
FIG. 4 is a side view of the tubular injector apparatus illustrated in FIG. 3, with the tubing guide removed for brevity.

Referring now to FIGS. 3 and 4 of the drawings, in another preferred embodiment of the invention a coiled tubing injector with a snubbing-type jack or lifting mechanism and oscillator (coiled tubing injector apparatus) for running coiled tubing 6 in a well, is generally illustrated by reference numeral 5 and includes an oscillator 22, which is identical to the oscillator 22 detailed in the tubular injector apparatus 1 illustrated in FIGS. 1, 1A, 1B and 2. However, as illustrated in FIGS. 3 and 4, the snubbing-type jack or lifting mechanism 39 does not directly handle the coiled tubing 6 and the vibration isolators or reflectors 28 are mounted by means of the reflector mount pins 29 on a base plate 3, which is seated on four threaded pistons 7*b* that are extendible in double-action service from corresponding cylinder housings 7*a* of four fluid cylinders 7. Each of the threaded ends of the pistons 7*b* is typically extended through an opening (not illustrated) drilled or otherwise provided in the base plate 3 and is secured in place by means of nuts 4 on the top and bottom of the base plate 3, as illustrated. The bottom ends of each cylinder housing 7*a* of the fluid cylinders 7 are seated in a corresponding one of four cylinder housing mounts 8 and a mount pin 8*a* extends through registering openings (not illustrated) provided in each cylinder housing 7*a* and the corresponding cylinder housing mount 8, to facilitate removably mounting each fluid cylinder 7 in the corresponding cylinder housing mount 8. Each of the cylinder housing mounts 8 is, in turn, welded or otherwise fixed to a system of cross-members 13*b* that connect the four vertically-oriented frame legs 13*a* to define a mount frame 13, and facilitate supporting the oscillator 22 above the mount frame 13, such that the oscillator 22 can be raised and lowered with respect to the mount frame 13 by operation of the respective fluid cylinders 7. In a preferred structure, the four frame legs 13*a* are supported by the cross-members 13*b* to define a mount frame 13 that further encompasses a coiled tubing injector 14, having an injector housing 15, as further illustrated in FIGS. 3 and 4. The coiled tubing injector 14 is typically a conventional coiled tubing injector designed to inject the coiled tubing 6 into and from a well (not illustrated) and typically rests on the wellhead or other well structure or on the ground (not illustrated). The coiled tubing injector 14 includes a motor mount bracket 16 which seats an injector motor 17, fitted with a gearbox 18. Multiple tubing grippers 19 are provided in a gripper housing 20, the latter of which is fitted with gripper tensioners 21 to facilitate gripping the coiled tubing 6 and inserting the coiled tubing 6 into the well and removing the coiled tubing 6 from the well, in conventional fashion. The coiled tubing 6 is typically secured when necessary in the oscillator 22 by clamps such as the rod clamps 10, having clamp jaws 11, connected by jaw bolts 12 and nuts 4, as further illustrated in FIGS. 3 and 4. Accordingly, it will be appreciated from a consideration of FIGS. 3 and 4 that the coiled tubing 6 is conventionally wound on a tubing reel (not illustrated) and extends from the tubing reel to a coiled tubing guide 37, where the boiled tubing 6 projects through the top rod clamp 10, the tubular stem 9 in the oscillator 22, the bottom rod clamp 10 and through the coiled tubing injector 14 that serves to insert the coiled tubing 6 into a well bore (not illustrated) and remove the coiled tubing 6 from the well bore, as desired, according to the knowledge of those skilled in the art.

Referring again to FIGS. 1 and 2 of the drawings the snubbing jack 30 element of the tubular injector apparatus 1 of this invention is a typical well servicing system device used in many applications where there is no overhead derrick or other pipe-handling apparatus. The snubbing jack 30 is mounted on an oil or gas well (not illustrated), provided with a wellhead or other well structure (also not illustrated), typically fitted with a blowout preventer 31 (FIG. 2). As further illustrated in FIG. 2, the snubbing jack 30 is secured to the blowout preventer 31, typically by means of a spool 32, having an upper flange 32*a*, attached to the bottom of the snubbing jack 30, as hereinafter described, and a lower flange 32*b*, attached to the blowout preventer 31. The blowout preventer 31 is standard or conventional in design and typically includes an internal bag mechanism (not illustrated) which may be selectively pressurized to close around a jointed tubular 2 (FIG. 1), that extends through the blowout preventer 31, to prevent leakage between the tubular 2 and the blowout preventer 31 as the tubular 2 is advanced into and out of the well bore (not illustrated) of the oil or gas well. The blowout preventer 31 is typically mounted on additional conventional ram-type blowout preventers (not illustrated) which are supported on a master valve (not illustrated), mounted on a wellhead (not illustrated), secured on the upper end of the well casing. As further illustrated in FIG. 1, the snubbing jack 30 includes a stabilizing tube assembly 34 which is telescopically extendible from a tube assembly cylinder 34*a*, centrally mounted on a bottom cylinder plate 35, as illustrated in FIG. 2. A top cylinder plate 40 is provided on the upper end of the stabilizing tube assembly 34, and a pair of large-cylinder assemblies 41 and a pair of small cylinder assemblies 42 are mounted between the bottom cylinder plate 35 and top cylinder plate 40, for selectively raising and lowering the top cylinder plate 40, as hereinafter further described. Each of the large cylinder assemblies 41 includes a large cylinder 41*a* and a large cylinder piston rod 41*b*, telescopically extendible from each large cylinder 41*a*. Each large cylinder 41*a* is provided with a large cylinder base flange 41*d*, typically bolted to the bottom cylinder plate 35, as illustrated in FIG. 2. The upper end of each large cylinder piston rod 41*b* is fitted with a piston rod flange 41*e*, as illustrated in FIG. 1, and each piston rod flange 41*e* is typically bolted to the underside of the top cylinder plate 40. Each small cylinder assembly 42 includes a small cylinder 42*a* and a small cylinder piston 42*b*, slidably extendible from the small cylinder 42*a*. As illustrated in FIG. 2, the bottom end of each small cylinder 42*a* is provided with a small cylinder base flange 42*d*, typically bolted to the bottom cylinder plate 35. The upper end of each small cylinder piston rod 42*b* is provided with a piston rod flange 42*e*, which is typically bolted to the underside of the top cylinder plate 40. Each large cylinder assembly 41 and small cylinder assembly 42 is typically a conventional, double-acting hydraulic unit designed for introduction of hydraulic power fluid into the large cylinder 41*a* and small cylinder 42*a*, typically through a hydraulic power fluid network 160, which is connected to a source of hydraulic fluid and a control system (not illustrated) according to the knowledge of those skilled in the art. Accordingly, the large cylinder piston rod 41*b* and small cylinder piston rod 42*b* may be selectively extended from and retracted into the respective large cylinder 41*a* and small cylinder 42*a* by application of hydraulic pressure, in conventional fashion.

As further illustrated in FIG. 1, a traveling slip assembly 33 is mounted on the top cylinder plate 40. The large cylinder assemblies 41 and small cylinder assemblies 42 are operated to selectively raise and lower the traveling slip assembly 33 on the top cylinder plate 40, and accomplish running and pulling the tubular 2 in the well bore during snubbing and lifting operations of the snubbing jack 30, as hereinafter described. As further illustrated in FIG. 2, the large cylinder assemblies 41 and small cylinder assemblies 42 are mounted on the bottom cylinder plate 35 in alternating and symmetrical relationship around the stabilizing tube assembly piston 34 and stabilizing tube assembly cylinder 34*a*. Such symmetrical arrangement permits the application of balanced forces to the top cylinder plate 40 when using either or both sets of cylinder assemblies 41 and 42, as needed, to raise or lower the traveling slip assembly 33.

Referring again to FIG. 1, bottom stanchions 185 extend upwardly from the rectangular top cylinder plate 40 at the respective corners thereof, and a rectangular bottom plate 184 is supported on the bottom stanchions 185. Middle stanchions 183 extend upwardly from the bottom plate 184 at respective corners thereof and a rectangular middle plate 182 is supported on the middle stanchions 183. The traveling slip assembly 33, supported on the top cylinder plate 40, extends through aligned slip assembly openings (not illustrated) provided in the bottom plate 184 and middle plate 182, respectively. Top stanchions 181 extend upwardly from the middle plate 182 at respective corners thereof and a top plate 180 is supported on the middle stanchions 181. A tubular opening (not illustrated) is provided in the top plate 180 for accommodating the assembled, vertical tubular 2. A tubing tong unit or rotary table 43, the purpose of which will be hereinafter further described, is mounted on a table stanchion 186, supported on the top plate 180 and the rotary table 43 is positioned above the top plate 180. Accordingly, as the rotary table 43 is raised and lowered with the traveling slip assembly 33 on the top cylinder plate 40 and the tubular 2 is inserted into or removed from the well bore responsive to operation of the large cylinder assembly 41 and small cylinder assembly 42, as hereinafter further described, the rotary table 43 is selectively operated to rotate the tubular 2 about its axis, in order to perform cleanout and drilling operations in the well bore and facilitate forming or breaking joints between tubular segments. A work platform 44 is supported on a frame 45, secured to the tube assembly 34*a* cylinder by means of a mounting plate 50. The work platform 44 serves to support operating personnel for the snubbing jack 30, and is typically the location of the control panels (not shown), used in operating the snubbing jack 30. A safety guard ring 46 is provided on the frame 45, typically on the middle stanchions 183, and encircles in the traveling slip assembly 33 for safety purposes. As illustrated in FIG. 2, the bottom plate 35 (upon which the large cylinders 41*a*, small cylinders 42*a* and tube assembly cylinder 34*a* are mounted) is supported on a mounting flange 150, supported on the top frame plate 170 of a fixed slip assembly frame 51, which further includes a bottom frame plate 172 and vertical frame stanchions 171 that extend through respective corners of the top frame plate 170 and bottom frame plate 172. A top slip assembly 52 is attached to the bottom surface of the top frame plate 170, in communication with the mounting flange 150, through the top frame plate 170. A bottom slip assembly 53, axially aligned with the top slip assembly 52 and with the well bore, is attached to the top surface of the bottom frame plate 172, in communication with the blowout preventer 31, through the bottom frame plate 172 and the spool 32. The top slip assembly 52 is operated to engage or grip the assembled tubular 2 as the tubular 2 is pushed into the well bore against well pressure by operation of the traveling slip assembly 33, during snubbing operation of the snubbing jack 30, as hereinafter further described. In similar fashion, the bottom slip assembly 53 is operated to grip the tubular 2 as the tubular 2 is inserted into or extended from the well bore, when the weight of, the assembled tubular 2 exceeds the well bore pressure. A mast or gin pole 54 is mounted on a support member 55, secured to the frame 51, for lifting or lowering tubing lengths or segments (not illustrated) when assembling or disassembling the tubular 2 from the tubing segments before and after use, respectively, as hereinafter described. The gin pole 54 is typically characterized by a standard, hydraulically-extendible mast which includes a pulley 60, over which a line (not shown) is run to facilitate raising and lowering the tubular segments of the tubular 2.

In a typical snubbing operation using the snubbing jack 30 in cooperation with the oscillator 22, each tubular segment (not illustrated) of the tubular 2 is individually raised by operation of the gin pole 54, to a position above the rotary table 43 and the tubular stem 9 of the oscillator 22, and then lowered through the rod clamps 10, the tubular stem 9 and the traveling slip assembly 33, into the snubbing jack 30. As the tubular segments are rotated by operation of the rotary table 43 and threaded together in the nascent tubular 2, the large cylinder assembly 41 and small cylinder assembly 42 are operated to raise the traveling slip assembly 33, which is then operated in conventional fashion to engage the tubular 2, which moves freely in the tubular stem 9 and rod clamps 10 of the oscillator 22. The traveling slip assembly 33 is next lowered with the top cylinder plate 40 by operation of the large cylinder assembly 41 and small cylinder assembly 42, forcing the tubular 2 downwardly through the upper fixed slip assembly 52, lower fixed slip assembly 53 and blowout preventer 31, and into the well bore (not illustrated). When the large cylinder piston 41*b* and small cylinder piston 42*b* are fully retracted into the large cylinder 41*a* and small cylinder 42*a*, respectively, the upper fixed slip assembly 52 or lower fixed slip assembly 53 is operated, to grip and hold the tubular 2 against either the weight of the tubular 2 or against the well pressure, depending on operating conditions. Simultaneously, the traveling slip assembly 33 is released from the tubular 2 and raised by operation of the large cylinder assembly 41 and small cylinder assembly 42, and then operated to again grip and then force another increment of the tubular 2 downwardly by lowering operation of the large cylinder assembly 41 and small cylinder assembly 42. The length of each raised or lowered increment of the tubular 2 depends on the degree of extension of each large cylinder piston 41*b* and small cylinder piston 42*b* from the large cylinder 41*a* and small cylinder 42*a*, respectively. As this process is repeated, the tubular 2 is assembled and forced downwardly into the well bore against bore pressure as the multiple tubing segments are connected in conventional manner. The snubbing jack 30 is operated to lift the assembled tubular 2 from the well bore, as desired, by operating the traveling slip assembly 33 to sequentially engage the tubular 2 at the retracted or lowered position of the large cylinder assemblies 41 and small cylinder assemblies 42, and then operating the large cylinder assemblies 41 and small cylinder assemblies 42 to lift the tubular 2 from the well bore. The upper fixed slip assembly 52 or lower fixed slip assembly 53 is operated to engage and hold the tubular 2 while the disengaged traveling slip assembly 33 is moved from the upper to the lower position to re-engage the tubular 2, and then to release the tubular 2 while the traveling slip assembly 33 lifts the tubular 2. Simultaneously, the tubular 2 extends through and is rotated by the rotary table 43, to facilitate disassembly of the tubular 2 by successively unthreading the tubular segments (not illustrated) from the tubular 2.

The snubbing jack 30 is characterized by maximum stability imparted by the stabilizing tube assembly piston 34, the stabilizing tube assembly cylinder 34*a* and the snubbing and lifting speeds of the snubbing jack 30 can be varied, as desired, by selective operation of the large cylinder assembly 41 and small cylinder assembly 42. The selectivity provided in the speed of operation of the snubbing jack 30 permits correlation of the snubbing and lifting speeds of the tubular 2 with the weight of the tubular 2 and other operating conditions of the snubbing jack 30. During both snubbing and lifting operations, the weight of the tubular 2 varies as the length of the tubular 2 increases and decreases. The weight of the tubular 2 is continually monitored, and the snubbing or lifting speed varied in inverse relationship to the weight capacity. The maximum weight of the tubular 2 is handled at the lowest operating speed of the large cylinder assembly 41 and small cylinder assembly 42, and the speed of the large cylinder assembly 41 and small cylinder assembly 42 is increased to a maximum at the minimum weight of the tubular 2. For example, as the tubular 2 is initially lifted from the well bore after the snubbing operation, the maximum weight of the tubular 2 is exerted on the snubbing jack 30, since most of the tubular 2 is suspended in the well bore. As the tubular 2 is rotated by the rotary table 43 as it is pulled from the well bore, the tubular segments are removed from the tubular 2 and the tubular 2 becomes lighter. Accordingly, when the tubular 2 has initially begun to be raised from the well bore, the snubbing jack 30 is operated at the lowest, speed. As the tubular 2 is disassembled at the tubular joints (not illustrated), the weight of the tubular 2 is reduced and the snubbing jack 30 is shifted to a higher operating speed. The system speed sequentially increases as the weight of the tubular 2 decreases, until the last tubular segment is extracted from the well bore at maximum speed. In similar fashion, during the snubbing operation as the tubular 2 is inserted or lowered into the well bore, the speed of the snubbing jack 30 is decreased to correlate with the increasing weight of the nascent tubular 2.

In operation, the embodiment of the tubular injector apparatus 1 of this invention illustrated in FIGS. 1, 1A, 1B and 2 is used as follows: During a typical tubular running operation the snubbing jack 30 is operated as indicated above, with the tubular 2 extending through the rod clamps 10 and the tubular stem 9 of the oscillator 22 and through the snubbing jack 30, as illustrated in FIG. 1. Either the oscillator 22 may be "stripped" on the tubular 2 or the tubular 2 may be extended through the tubular stem 9 of the oscillator 22 and then through the snubbing jack 30 as described above, to facilitate operation of the snubbing jack 30 in conventional fashion with the tubular 2 running freely through the tubular stem 9 of the oscillator 22. Under circumstances where a difficulty in insertion or removing the tubular 2 into or from the well (not illustrated) is encountered during normal operation of the snubbing jack 30, the rod clamps 10 located on both ends of the vertically-oriented tubular stem 9 are tightened to secure the oscillator 22 on the tubular 2. The clamping of the rod clamps 10 on the tubular 2 is effected by tightening the nuts 4 located on the jaw bolts 12 to in turn, tighten the clamp jaws 11 of the rod clamps 10 on the tubular 2 and secure the tubular 2 in place in the tubular stem 9 of the oscillator 22. When this is accomplished, the snubbing jack 30 is operated as indicated above to first release the traveling slip 33, maintaining the stationary top slip assembly 52 and bottom slip assembly 53 in place on the tubular 2. The large cylinder assemblies 41 and small cylinder assemblies 42 are then operated to raise the top cylinder plate 40 and upper unit of the snubbing jack 30, tension the vibration isolators or reflectors 28 and load the rod clamps 10. The stationary top slip assembly 51 and bottom slip assembly 52 are then released from the tubular 2 to release the load represented by the downhole segment of the tubular 2 from the top slip assembly 52 and the bottom slip assembly 53. When this is accomplished, the entire load of the tubular 2 is supported by the rod clamps 10 of the oscillator 22 and the oscillator 22 is isolated from the snubbing jack 30 as to vibration, by means of the vibration isolators or reflectors 28, which are now further compressed on the reflector mount pins 29 to act as vibration isolators, reflectors and insulators during operation of the oscillator 22. Since the oscillator 22 is now firmly attached to the tubular 2 and is vibrationally isolated from the snubbing jack 30, operation of the eccentric drive motors 24, which are typically hydraulic, is effected to rotate the respective eccentrics 26 and effect a vibration and oscillation at a resonant frequency to the tubular 2. In the course of applying a resonant frequency to the tubular 2, the oscillator 22 generates an axial sinusoidal force that can be tuned to a specific frequency within the operating range of the oscillator 22. The force generated by the oscillator 22 acts on the tubular 2 to create axial vibration of the downhole segment of the tubular 2. When tuned to a resonant frequency of the system, energy developed at the oscillator 22 is efficiently transmitted to the stuck downhole segment of the tubular 2, with the only losses being those that are attributed to frictional resistance. The effect of the tubular 2 reactance is eliminated because mass induction is equal to spring capacitance at the resonant frequency. Other aspects of the oscillator 22 operation is the fluidization of the granular particles downhole in the event that the cause of the stuck downhole segment of the tubular 2 results from a cave in or silting of the hole or jamming of the downhole objects to create a mechanical wedging action against the downhole segment of the tubular 2. When excited by a vibration from the oscillator 22, the granular particles are transformed into a fluidic state that offers little resistance to the movement of the tubular 2 upwardly or downwardly by operation of the snubbing jack 30. In effect, the granular media takes on the characteristics and properties of a liquid and facilitates extraction of the tubular 2 by elevating and/or lowering the tubular 2, as described above. After the tubular 2 is loosened in the well, the stationary top slip assembly 52 and bottom slip assembly 53 are again operated in the snubbing jack 30 to engage the tubular 2. The large cylinder assemblies 40 and small cylinder assemblies 42 are then operated to lower the top cylinder plate 40 and the upper unit of the snubbing jack 30, remove the tension from the vibration isolators or reflectors 28 and unload the rod clamps 10. The rod clamps 10 are then loosened to free the oscillator 22 from the tubular 2. Furthermore, the top slip assembly 52, the bottom slip assembly 53, as well as the traveling slip assembly 33, are caused to re-engage the tubular 2, wherein the snubbing jack 30 is operated as discussed above to "run" the tubular 2 in and out of the well.

Referring now to FIGS. 3 and 4 of the drawings in another preferred embodiment of the invention the tubular injector with snubbing jack and oscillator of this invention, designated a coiled tubing injector apparatus 5, is designed to handle coiled tubing as heretofore described. As further heretofore described, the oscillator 22 is the same in design as the oscillator 22 utilized in the tubular injector apparatus 1 illustrated in FIGS. 1, 1A, 1B and 2. However, the lifting mechanism or snubbing-type jack 39 includes four fluid cylinders 7, with the cylinder housings 7*a* secured to the four corners of a mount frame 13 as heretofore described and as illustrated in FIGS. 3 and 4. Accordingly, operation of the respective pistons 7*b* in the cylinder housing 7*a* raise and lower the base plate 3 upon which the oscillator 22 is mounted. Appropriate hydraulic lines and motors (not illustrated) are attached to the typically double-action fluid cylinders 7 for operation, thereof, according to the knowledge of those skilled in the art. Furthermore, the "gooseneck" coiled tubing guide 37 is positioned above the oscillator 22 by means of the "gooseneck" support 38 and serves to feed the coiled tubing 6 from a reel (not illustrated) through the top rod clamp 10 and into the tubular stem 9 of the oscillator 22 and from the tubular stem 9 downwardly through the bottom rod clamp 10 and into the coiled tubing injector 14, fitted with a conventional tubing grippers 19, as illustrated in FIG. 4. Consequently, the coiled tubing 6 can be "run" in a well (not illustrated) located beneath the frame 13 by operation of the coiled tubing injector 14 in conventional fashion. Under circumstances where an obstacle is encountered downhole in the well and the coiled tubing 6 cannot be either raised or lowered, as the case may be, by operation of the coiled tubing injector 14, the oscillator 22 can be secured to the coiled tubing 6 in the same manner as illustrated above with respect to the tubular injector apparatus 1 illustrated in FIGS. 1, 1A, 1B and 2, utilizing the rod clamps 10. The fluid cylinders 7 are then operated to raise the base plate 3 and apply a compressive load on the vibration isolators or reflectors 28, after which the tubing grippers 19 are released from the coiled tubing 6 by operating the gripper tensioners 21 in the coiled tubing injector 14 in conventional fashion and facilitate release of the load on the coiled tubing 6 by the coiled tubing injector 14. Consequently, the coiled tubing injector 14 is completely isolated from the oscillator 22 with regard to vibration by operation of the vibration isolators or reflectors 28, which are now compressed because of the load of the downhole coiled tubing 6 on the respective rod clamps 10 of the oscillator 22. The oscillator 22 is then operated as described above with respect to the tubular injector apparatus 1 illustrated and described with regard to FIGS. 1, 1A, 1B and 2, to loosen the coiled tubing downhole as the snubbing jack 39 is operated up and/or down to move the oscillator 22 and coiled tubing 6 up and/or down in the well. After the coiled tubing 6 is loosened in the well, the gripper tensioners 21 in the coiled tubing injector 14 are operated to cause the tubing grippers 19 to again engage the coiled tubing 6, the fluid cylinders 7 are operated to lower the base plate 3 and "unload" the vibration isolators or reflectors 28 and the rod clamps 10 are loosened on the coiled tubing 6 as the weight of the coiled tubing 6 is transferred to the coiled tubing injector 14. The coiled tubing injector 14 is then operated as heretofore described to "run" the coiled tubing 6 in the well.

It will be appreciated by those skilled in the art that one of the advantages of utilizing the coiled tubing injector apparatus 5 aspect of the invention illustrated in FIGS. 3 and 4, is the facility for manipulating the coiled tubing 6 directly from the tubing reel (not illustrated) without the necessity of cutting the coiled tubing 6 during normal operations of the coiled tubing injector 14. This facility is extended to circumstances where the coiled tubing 6 may be stuck downhole and may require the operation of the oscillator 22 to free the coiled tubing 6. Furthermore, in both of the embodiments illustrated in the drawings, a primary advantage of using the snubbing jack 30 and snubbing-type jack or lifting mechanism 39 in the respective embodiments of the invention, is the elimination of the necessity of using a derrick or overhead support device or structure for "running" coiled tubing or other tubulars, including drill pipe and the like, in and out of the well. Consequently, both the tubular injector apparatus 1 illustrated in FIGS. 1, 1A, 1B and 2, and the coiled tubing apparatus 5, illustrated in FIGS. 3 and 4, can be easily used on offshore platforms, as well as on land, to effect the running of drill pipe and to facilitate freeing of stuck drill pipe downhole utilizing the oscillator 22.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A tubular injector apparatus for inserting a jointed tubular into a well bore of an oil or gas well and lifting the tubular from the well bore, said tubular injector apparatus comprising a snubbing jack for selectively inserting the tubular into the well bore and lifting the tubular from the well bore and an oscillator provided on said snubbing jack for selectively engaging the tubular and vibrating the tubular in the well bore.

2. The tubular injector of claim 1 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engagement of the tubular by said oscillator and operation of said drive motor.

3. The tubular injector of claim 1 wherein said snubbing jack comprises a traveling slip assembly for removably engaging the tubular at successive longitudinally-spaced positions on the tubular; at least one cylinder assembly operably engaging said traveling slip assembly for selectively reciprocating said traveling slip assembly in said snubbing jack; and at least one fixed slip assembly provided in axial alignment with said traveling slip assembly for engaging the tubular when said traveling slip assembly moves from a first position to a second position on the tubular responsive to operation of said at least one cylinder assembly, wherein said fixed slip assembly is operated to release the tubular as said traveling slip assembly engages the tubular and incrementally inserts or lifts the tubular in the well bore, responsive to operation of said at least one cylinder assembly, and said travelling slip assembly and said fixed slip assembly release the tubular after said oscillator engages the tubular.

4. The tubular injector of claim 3 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engagement of the tubular by said oscillator and operation of said drive motor.

5. The tubular injector of claim 1 comprising a tubular stem provided on said oscillator for receiving the tubular and at least one clamp provided on said oscillator for selectively engaging the tubular and securing said oscillator on the tubular.

6. The tubular injector of claim 5 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engagement of the tubular by said oscillator and operating said drive motor.

7. The tubular injector of claim 5 wherein said snubbing jack comprises a traveling slip assembly for removably engaging the tubular at successive longitudinally-spaced positions on the tubular; at least one cylinder assembly operably engaging said traveling slip assembly for selectively reciprocating said traveling slip assembly in said snubbing jack; and at least one fixed slip assembly provided in axial alignment with said traveling slip assembly for engaging the tubular when said traveling slip assembly moves from a first position to a second position on the tubular responsive to operation of said at least one cylinder assembly, and wherein said fixed slip assembly is operated to release the tubular as said traveling slip assembly engages the tubular and incrementally inserts or lifts the tubular in the well bore, responsive to operation of said at least one cylinder assembly and said travelling slip assembly and said fixed slip assembly release the tubular after said oscillator engages the tubular.

8. The tubular injector of claim 7 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engagement of the tubular by said oscillator and operating said drive motor.

9. The tubular injector of claim 2 wherein said at least one eccentric comprises a pair of eccentrics provided on each of said eccentric shafts for uniformly vibrating the tubular in the well bore responsive to engaging of said tubular by the oscillator and operating said drive motor.

10. The tubular injector of claim 9 wherein said snubbing jack comprises a traveling slip assembly for removably engaging the tubular at successive longitudinally-spaced positions on the tubular; at least one cylinder assembly operably engaging said traveling slip assembly for selectively reciprocating said traveling slip assembly in said snubbing jack; and at least one fixed slip assembly provided in axial alignment with said traveling slip assembly for engaging the tubular when said traveling slip assembly moves from a first position to a second position on the tubular responsive to operation of said at least one cylinder assembly, wherein said fixed slip assembly is operated to release the tubular as said traveling slip assembly engages the tubular and incrementally inserts or lifts the tubular in the well bore, responsive to operation of said at least one cylinder assembly, and said travelling slip assembly and said fixed slip assembly release the tubular after said oscillator engages the tubular.

11. The tubular injector of claim 9 comprising a tubular stem provided on said oscillator for receiving the tubular; a base plate carried by said snubbing jack; at least one vibration isolator or reflector upward-standing from said base plate and wherein said oscillator is mounted on said isolator or reflector for isolating said mount frame from vibration by said oscillator; and at least one clamp provided on said oscillator for selectively engaging the tubular and securing said oscillator on the tubular, as said oscillator is operated to vibrate the tubular.

12. The tubular injector of claim 11 wherein said snubbing jack comprises a traveling slip assembly for removably engaging the tubular at successive longitudinally-spaced positions on the tubular; at least one cylinder assembly operably engaging said traveling slip assembly for selectively reciprocating said traveling slip assembly in said snubbing jack; and at least one fixed slip assembly provided in axial alignment with said traveling slip assembly for engaging the tubular when said traveling slip assembly moves from a first position to a second position on the tubular responsive to operation of said at least one cylinder assembly, wherein said fixed slip assembly is operated to release the tubular as said traveling slip assembly engages the tubular and incrementally inserts or lifts the tubular in the well bore, responsive to operation of said at least one cylinder assembly, and said travelling slip assembly and said fixed slip assembly release the tubular after said oscillator engages the tubular.

13. A tubular injector apparatus for inserting a jointed tubular into a well bore of an oil or gas well and lifting the tubular from the well bore, said tubular injector comprising a snubbing jack for selectively inserting the tubular into the well bore and lifting the tubular from the well bore; a base plate carried by said snubbing jack; a plurality of vibration isolators or reflectors upward-standing from said base plate, and an oscillator provided on said vibration reflectors for selectively engaging the tubular and vibrating the tubular in the well bore.

14. The tubular injector of claim 13 wherein said oscillator comprises an oscillator housing supported on said vibration reflectors; a pair of eccentric shafts extending through said oscillator housing; at least one first eccentric mounted on one of said eccentric shafts and at least one second eccentric mounted on the other of said eccentric shafts; and a pair of drive motors operably engaging said eccentric shafts, respectively, whereby said first eccentric and said second eccentric are rotated with said eccentric shafts, respectively, to vibrate the tubular in the well bore, responsive to engaging said oscillator with the tubular and operating said drive motors.

15. The tubular injector of claim 13 comprising a tubular stem provided on said oscillator for receiving the tubular and at least one clamp provided on said oscillator for selectively engaging the tubular and securing said oscillator on the tubular, as said oscillator is operated to vibrate the tubular.

16. The tubular injector of claim 15 wherein said oscillator comprises an oscillator housing supported on said vibration reflectors; a pair of eccentric shafts extending through said oscillator housing; a first set of eccentrics mounted on one said eccentric shafts and a second set of eccentrics mounted on the other of said eccentric shafts; and a pair of drive motors operably engaging said eccentric shafts, respectively, whereby said first set of eccentrics and said second set of eccentrics are rotated with said eccentric shafts, respectively, to vibrate the tubular in the well bore, responsive to engaging said tubing stem with the tubular and operating said drive motors.

17. The tubular injector of claim 16 wherein said at least one clamp comprises a pair of clamps provided on said oscillator for selectively engaging the tubular and securing said oscillator on the tubular as said oscillator is operated to vibrate the tubular.

18. A coiled tubing injector apparatus for inserting coiled tubing into a well bore of an oil or gas well and lifting the coiled tubing from the well bore, said coiled tubing injector apparatus comprising a coiled tubing injector for selectively inserting the coiled tubing into the well bore and lifting the coiled tubing from the well bore; a mount frame positioned over said coiled tubing injector; an oscillator supported on said mount frame for selectively engaging the coiled tubing and vibrating the coiled tubing in the well bore; and a coiled tubing guide disposed above said coiled tubing injector for feeding the coiled tubing through the oscillator and into the coiled tubing injector.

19. The coiled tubing injector of claim 18 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engaging said oscillator with the tubular and operating said drive motor.

20. The coiled tubing injector of claim 18 wherein said mount frame comprises a vertically-adjustable base plate and wherein said oscillator rests on said base plate.

21. The coiled tubing injector of claim 18 wherein said mount frame comprises a vertically-adjustable base plate and said oscillator rests on said base plate and wherein said oscillator comprises a housing, a pair of eccentric shafts journalled for rotation in said housing, at least one eccentric mounted on each of said eccentric shafts and a drive motor operably engaging each of said eccentric shafts for rotating said eccentric; whereby said eccentric is rotated with each of said eccentric shafts and the tubular is vibrated in the well bore, responsive to engaging said oscillator with the tubular and operating said drive motor.

22. The coiled tubing injector of claim 18 comprising a tubular stem provided on said oscillator for receiving the coiled tubing and at least one clamp provided on said oscillator for selectively engaging the tubular and securing said oscillator on the tubular as said oscillator is operated.

23. The coiled tubing injector of claim 22 wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engaging said oscillator with the tubular and operating said drive motor.

24. The coiled tubing injector of claim 22 wherein said mount frame comprises a vertically-adjustable base plate and wherein said oscillator is mounted on said base plate.

25. The coiled tubing injector of claim 22 wherein said mount frame comprises a vertically-adjustable base plate and wherein said oscillator is mounted on said base plate and wherein said oscillator comprises a housing, a pair of eccentric shafts journalled for rotation in said housing, at least one eccentric mounted on each of said eccentric shafts and a drive motor operably engaging each of said eccentric shafts for rotating said eccentric, whereby said eccentric is rotated with each of said eccentric shafts and the tubular is vibrated in the well bore, responsive to engaging said oscillator with the tubular and operating said drive motor.

26. The coiled tubing injector of claim 19 wherein said at least one eccentric comprises a pair of eccentrics provided on each of said eccentric shafts for uniformly vibrating the tubular in the well bore responsive to engaging of said tubular by the oscillator and operating said drive motor.

27. The tubular injector of claim 26 wherein said mount frame comprises a vertically-adjustable base plate, at least one vibration isolator or reflector provided on said base plate and wherein said oscillator is mounted on said vibration isolator or reflector for isolating said mount frame from vibration by said oscillator.

28. The tubular injector of claim 26 comprising a tubular stem provided in said oscillator for receiving the coiled tubing and at least one clamp provided on said oscillator for selectively engaging the tubular and securing said oscillator on the tubular.

29. The tubular injector of claim 26 wherein said mount frame comprises a vertically-adjustable base plate, at least one vibration isolator or reflector provided on said base plate and wherein said oscillator is mounted on said vibration isolator or reflector for isolating said mount frame from vibration by said oscillator, and comprising a tubular stem provided in said oscillator for receiving the coiled tubular and at least one clamp provided on said oscillator for selectively engaging the tubular and securing said oscillator on the tubular as said oscillator is operated.

30. A coiled tubing injector apparatus for inserting a coiled tubing into a well bore of an oil or gas well, lifting the coiled tubing from the well bore and freeing coiled tubing in the well bore, said coiled tubing injector apparatus comprising a coiled tubing injector for selectively inserting the coiled tubing into the well bore and lifting the coiled tubing from the well bore; a mount frame positioned over said coiled tubing injector, said mount frame comprising a frame base for resting on the well casing, wherein said coiled tubing injector rests on said frame base; multiple frame legs upward-standing from said frame base; at least one cylinder housing upward-standing from said frame base and a piston telescopically extendible from said cylinder housing; and a base plate supported on said piston, wherein said base plate is vertically adjustable with respect to said coiled tubing injector by operation of said cylinder and piston; a plurality of vibration isolators or reflectors upward-standing from said base plate; an oscillator mounted on said vibration reflectors for selectively engaging the coiled tubing and vibrating the coiled tubing in the well bore with said frame base insulated from vibration of said oscillator by said vibration isolators or reflectors; and a coiled tubing guide disposed above said injector for feeding the coiled tubing through said oscillator and into said coiled tubing injector.

31. The tubular injector of claim 30 wherein said oscillator comprises an oscillator housing supported on said vibration isolators or reflectors; a pair of eccentric shafts journalled for rotation in said oscillator housing; at least one eccentric mounted on each of said eccentric shafts; and a drive motor operably engaging each of said eccentric shafts, whereby said eccentric is rotated with each of said eccentric shafts and the tubular is vibrated in the well bore, responsive to engaging said oscillator with the tubular and operating said drive motor.

32. The coiled tubing injector of claim 30 comprising a tubular stem provided on said oscillator for receiving the coiled tubing and at least one clamp provided on said oscillator for selectively engaging and securing said oscillator on the tubular as said oscillator is operated.

33. The coiled tubing injector of claim 32 wherein said oscillator comprises an oscillator housing supported on said vibration isolators or reflectors; a pair of eccentric shafts journalled for rotation in said oscillator housing; at least one eccentric mounted on each of said eccentric shafts; and a drive motor operably engaging each of said eccentric shafts, whereby said eccentric is rotated with each of said eccentric shafts and the tubular is vibrated in the well bore, responsive to engaging said oscillator with the tubular and operating said drive motor.

34. The coiled tubing injector of claim 33 wherein said at least one eccentric comprises a pair of eccentrics provided on each of said eccentric shafts for uniformly vibrating the tubular in the well bore responsive to engaging of said tubular by the oscillator and operating said drive motor.

35. A method of using an oscillator with a snubbing jack in oil or gas well applications for receiving tubulars in a well, said method comprising:

(a) providing a snubbing jack in communication :with the well;

(b) providing an oscillator on said snubbing jack;

(c) extending the tubular through said oscillator and said snubbing jack into the well; and (d) operating said oscillator to engage the tubular and vibrate and release the tubular from the well in the event that the tubular becomes jammed or stuck in the well bore.

36. The method of claim 35 comprising providing vibration isolators or reflectors between said snubbing jack and said oscillator for isolating vibration of said oscillator from said snubbing jack.

37. The method of claim 35 comprising providing a tubing stem and at least one clamp on said oscillator for receiving and securely engaging the tubular and operating said snubbing jack to move said oscillator and the tubular in the well while said oscillator is vibrating the tubular.

38. The method of claim 35 comprising providing vibration isolators or reflectors between said snubbing jack and said oscillator for isolating vibration of said oscillator from said snubbing jack and providing a tubing stem and at least one clamp on said oscillator for receiving and securely engaging the tubular.

39. A method of using an oscillator with a coiled tubing injector apparatus in oil or gas well applications for receiving coiled tubing in a well bore, said method comprising:

(a) providing a coiled tubing injector in communication with the well bore;

(b) locating a fluid cylinder-operated mount frame over said coiled tubing injector;

(c) providing an oscillator on said mount frame;

(d) positioning a gooseneck coiled tubing guide over said oscillator;

(e) extending the coiled tubing through said gooseneck coiled tubing guide, through said oscillator and into said coiled tubing injector; and (f) operating said oscillator to engage the coiled tubing and vibrate and release the coiled tubing from the well bore in the event that the coiled tubing becomes jammed or stuck in the well bore.

40. The method of claim 39 comprising providing vibration isolators or reflectors between said mount frame and said oscillator for isolating vibration of said oscillator from said mount frame.

41. The method of claim 39 comprising providing a vertically-adjustable base plate on said mount frame.

42. The method of claim 39 comprising providing vibration isolators or reflectors between said mount frame and said oscillator for isolating vibration of said oscillator from said mount frame, and providing a vertically-adjustable base plate on said mount frame and operating said mount frame to move said oscillator and the tubular in the well while said oscillator is vibrating the tubular.

* * * * *

UNITED STATES PATENT AND TRADEMARK OFFICE

CERTIFICATE OF CORRECTION

PATENT NO. : 6,412,560 B1
DATED : July 2, 2002
INVENTOR(S) : Henry A. Bernat

It is certified that error appears in the above-identified patent and that said Letters Patent is hereby corrected as shown below:

Column 15,
Line 30, after “injector”, please delete “apparatus”

Column 17,
Line 32, after “injector”, please delete “apparatus”

Column 18,
Line 9, after “injector”, please delete “apparatus”

Column 19,
Lines 10, 16, 22 and 57, after “the”, please delete “tubular” and substitute therefor
-- coiled tubing --
Line 33, after “injector”, please delete “apparatus”

Signed and Sealed this

Twenty-seventh Day of April, 2004

JON W. DUDAS
*Acting Director of the United States Patent and Trademark Office*